US010634421B2

(12) United States Patent
Shou et al.

(10) Patent No.: US 10,634,421 B2
(45) Date of Patent: Apr. 28, 2020

(54) WATER DISPENSER WATER-OUTLET ASSEMBLY AND REFRIGERATOR

(71) Applicant: Hisense Ronshen (Guangdong) Refrigerator Co., Ltd., Foshan, Guangdong (CN)

(72) Inventors: Jun Shou, Guangdong (CN); Kangfu Yan, Guangdong (CN); Donghua Fu, Guangdong (CN); Jianqun Zhou, Guangdong (CN)

(73) Assignee: Hisense Ronshen (Guangdong) Refrigerator Co., Ltd., Foshan, Guangdong (CN)

( * ) Notice: Subject to any disclaimer, the term of this patent is extended or adjusted under 35 U.S.C. 154(b) by 121 days.

(21) Appl. No.: 16/023,296

(22) Filed: Jun. 29, 2018

(65) Prior Publication Data

US 2019/0234680 A1 Aug. 1, 2019

(30) Foreign Application Priority Data

Feb. 1, 2018 (CN) ..... 2018 1 0109048

(51) Int. Cl.
*F25D 23/12* (2006.01)
*B67D 3/00* (2006.01)
*F25D 31/00* (2006.01)

(52) U.S. Cl.
CPC ..... *F25D 23/126* (2013.01); *B67D 3/00* (2013.01); *F25D 31/002* (2013.01)

(58) Field of Classification Search
CPC ..... F25D 23/126; F25D 31/002; F25D 23/12; B67D 3/00; A47J 31/00; A47J 31/4403
See application file for complete search history.

(56) References Cited

U.S. PATENT DOCUMENTS 8,646,288 B2 2/2014 Lim et al.
2008/0202147 A1* 8/2008 Lim ..... B67D 1/0857 62/389
2015/0101670 A1 4/2015 Bird et al.

FOREIGN PATENT DOCUMENTS

CN 201875269 U 6/2011
CN 201977581 U 9/2011
(Continued)

OTHER PUBLICATIONS

Office Action received from the State Intellectual Property Office of People's Republic of China for Application No. 201810109048.4 dated Apr. 22, 2019 (Chinese language only) (6 pp.).
(Continued)

*Primary Examiner* — Emmanuel E Duke
(74) *Attorney, Agent, or Firm* — Brinks Gilson & Lione

(57) ABSTRACT

In a water dispenser water-outlet assembly for a refrigerator, the water-outlet assembly includes a housing disposed in a side wall of the refrigerator body; a water-outlet switch and a trigger mechanism are included in the housing, and the trigger mechanism includes a triggering member and a driving member; the driving member is configured to drive the triggering member to one-dimensionally slide in a direction parallel to the side wall; the triggering member is slidably connected to the housing, and the triggering member is configured to one-dimensionally slide in a direction parallel to the side wall to trigger the water-outlet switch when it is driven by the driving member. The water dispenser water-outlet assembly of the present disclosure can be used in a water dispenser in a refrigerator.

20 Claims, 5 Drawing Sheets

(56) References Cited

FOREIGN PATENT DOCUMENTS

| | | | |
|---|---|---|---|
| CN | 203928573 | U | 11/2014 |
| CN | 205018856 | U | 2/2016 |
| CN | 106402615 | A | 2/2017 |
| CN | 106642953 | A | 5/2017 |
| CN | 106802043 | A | 6/2017 |
| KR | 100794601 | B1 | 1/2008 |
| KR | 20-2009-0005818 | U | 6/2009 |
| KR | 20-0468527 | Y1 | 8/2013 |

OTHER PUBLICATIONS

Office Action received from the State Intellectual Property Office of People's Republic of China for Application No. 201810109048.4 dated Apr. 22, 2019 (with English translation) (7 pp.).
International Search Report dated Oct. 29, 2018 for PCT Application No. PCT/CN2018/093811, Chinese language only (11 pp.).

* cited by examiner

WATER DISPENSER WATER-OUTLET ASSEMBLY AND REFRIGERATOR

RELATED APPLICATION

This application claims priority to Chinese Patent Application No. 201810109048.4, filed on Feb. 1, 2018, titled "A WATER DISPENSER ASSEMBLY INSIDE REFRIGERATOR BODY AND REFRIGERATOR", which is herein incorporated by reference in its entirety.

TECHNICAL FIELD

The present disclosure relates to the technical field of refrigerators, in particular to a water dispenser water-outlet assembly for refrigerators and a refrigerator.

BACKGROUND

In the related art, water dispensers for refrigerators are mainly designed to be placed on the refrigerator door. A water storage box capable of store a certain amount of water is generally disposed inside the refrigerator door, and a cold drink machine component is connected to the lower end of the water storage box. The cold drink machine component passes from the hole inside the refrigerator door to the outside of the refrigerator door. A mounting box is disposed on the outside of the refrigerator door, and a press lever is disposed below the cold drink machine component on the outside of the refrigerator door. When needing water, the user can use the water cup or other containers to press inward to get water. Since the external mounting box of the water dispenser structure provided by the related art is inwardly concave, in order to ensure the insulation performance of the refrigerator, the door liner needs to be inwardly concave too. As a result, the water dispenser structure needs to have a thick thickness, therefore it cannot be directly applied to the inner wall of the refrigerator body.

SUMMARY

The embodiments of the present disclosure provide a water dispenser water-outlet assembly for refrigerators and a refrigerator.

In a first aspect, the embodiments of the present disclosure provide a water dispenser water-outlet assembly for refrigerators, wherein the water-outlet assembly comprises a housing disposed in a side wall of a refrigerator body, a water-outlet switch and a trigger mechanism are provided in the housing, and the trigger mechanism comprises a triggering member and a driving member;

the driving member is configured to drive the triggering member to one-dimensionally slide in a direction parallel to the side wall;

the triggering member is slidably connected to the housing, and the triggering member is configured to one-dimensionally slide in a direction parallel to the side wall to trigger the water-outlet switch when it is driven by the driving member.

In a second aspect, the embodiments of the present disclosure further provide a water dispenser water-outlet device for refrigerators, wherein the water-outlet device comprises a housing disposed in a side wall of a refrigerator body, a water-outlet switch and a trigger mechanism are provided in the housing, and the trigger mechanism comprises a triggering member and a driving member;

the driving member is configured to drive the triggering member to slide in a direction parallel to the side wall;

the triggering member is slidably connected to the housing, and the triggering member is configured to slide in a direction parallel to the side wall to trigger the water-outlet switch when it is driven by the driving member.

In a third aspect, the embodiments an embodiment of the present disclosure further provides a refrigerator, wherein the refrigerator comprises a refrigerator body, the refrigerator body comprises a compartment, and at least one side wall of the compartment is provided with the above-mentioned water dispenser water-outlet assembly.

BRIEF DESCRIPTION OF THE DRAWINGS

In order to describe the technical solutions in the embodiments of the present disclosure or in the related art more clearly, the accompanying drawings to be used in the description of the embodiments or the related art will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

Figure 1:
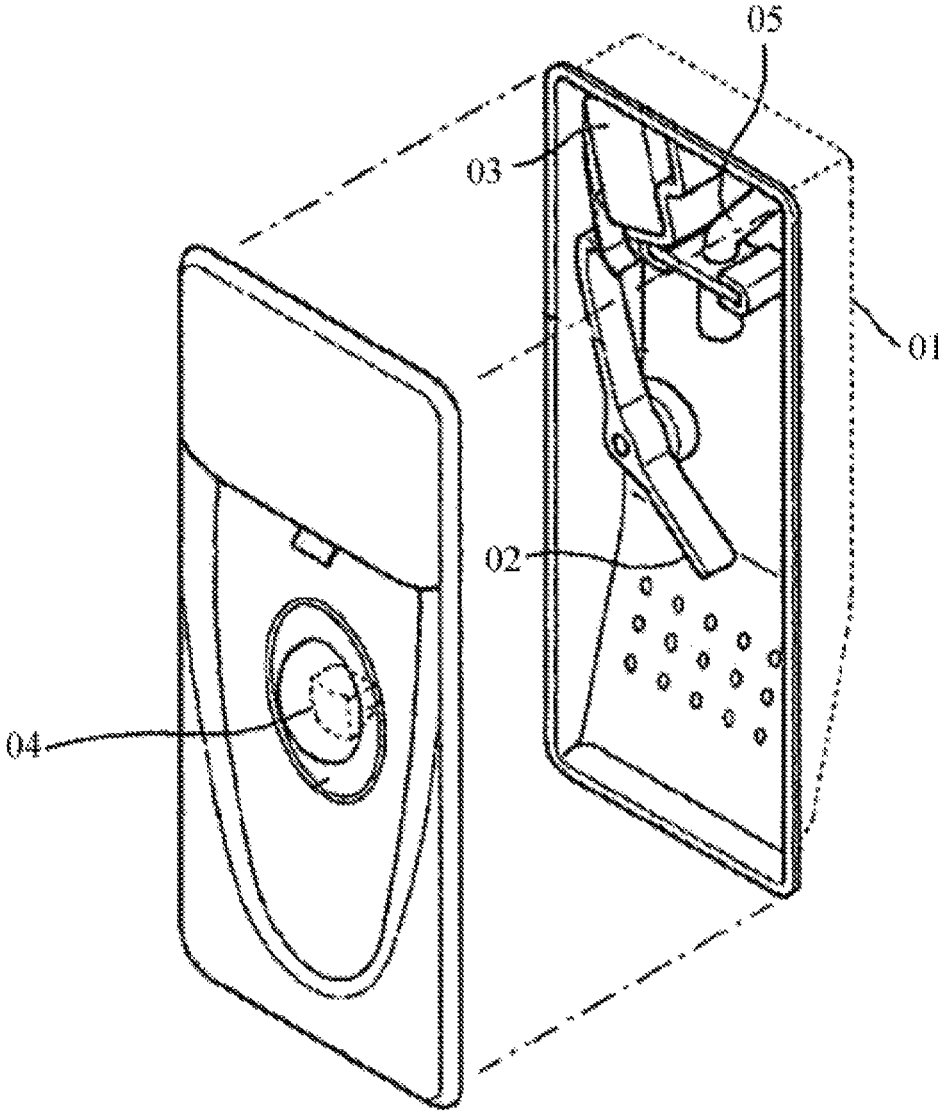
FIG. 1 (Prior Art)
FIG. 1 is a schematic view of the structure of a water dispenser inside a refrigerator body provided by the related art.

The technical solutions in the embodiments of the present disclosure will be described clearly and completely below with reference to the accompanying drawings in the embodiments of the present disclosure. Obviously, the described embodiments are merely some but not all of the embodiments of the present disclosure. All other embodiments obtained on the basis of the embodiments of the present disclosure by a person of ordinary skill in the art without paying any creative effort shall be included in the protection scope of the present disclosure.

It should be understood that in the description of the present disclosure, the terms "center", "upper", "lower", "front", "rear", "left", "right", "vertical", "horizontal", "top", "bottom", "inner", "outer", etc. indicate an orientation or positional relationship based on the orientation or relationship shown in the drawings, merely to facilitate and simplify the description of the present disclosure, but not to indicate or imply that the referred devices or elements must have a particular orientation, or must be constructed or operated in a particular orientation. Therefore they should not be construed as limitations to the present disclosure.

In the description of the present disclosure, it should be noted that the terms "mounted", "connected", and "connection" should be understood in a broad sense unless specifically defined or limited. For example, a connection may be a permanent connection, a detachable connection, or an integrated connection. For a person of ordinary skill in the art, the specific meanings of the above terms in the present disclosure should be understood according to specific circumstances.

The terms "first" and "second" are used for descriptive purposes only and should not be construed as indicating or implying the relative importance or implicitly indicating the number of the indicated technical features. Thus, features defined as "first", "second" may explicitly or implicitly include one or more of the features. In the description of the present disclosure, "a plurality of" means two or more unless otherwise specified.

In order to meet the new demand for water dispensers inside the refrigerator body, the related art has provided a water dispenser inside the refrigerator body, with its structure shown in FIG. 1. The water dispenser comprises a mounting box 01, in which a rotatable lever 02, an electronic switch 03, and a pressing block 04 are provided. When the pressing block 04 is pressed down, it will rotate the lever 02, thereby triggering the electronic switch 03 to let water run out from the water-outlet pipe 05.

However, in the technical solution shown in FIG. 1, since the lever 02 triggers the electronic switch 03 by rotating, it needs to occupy a large space in the vertical direction. As a result, the mounting box needs to be relatively high in the vertical direction, resulting in be less foam layer in the refrigerator body, thereby reducing the insulation performance of the refrigerator.

The related art above provides information relating to the present disclosure, and the related art is not necessarily prior art.

Figure 3:
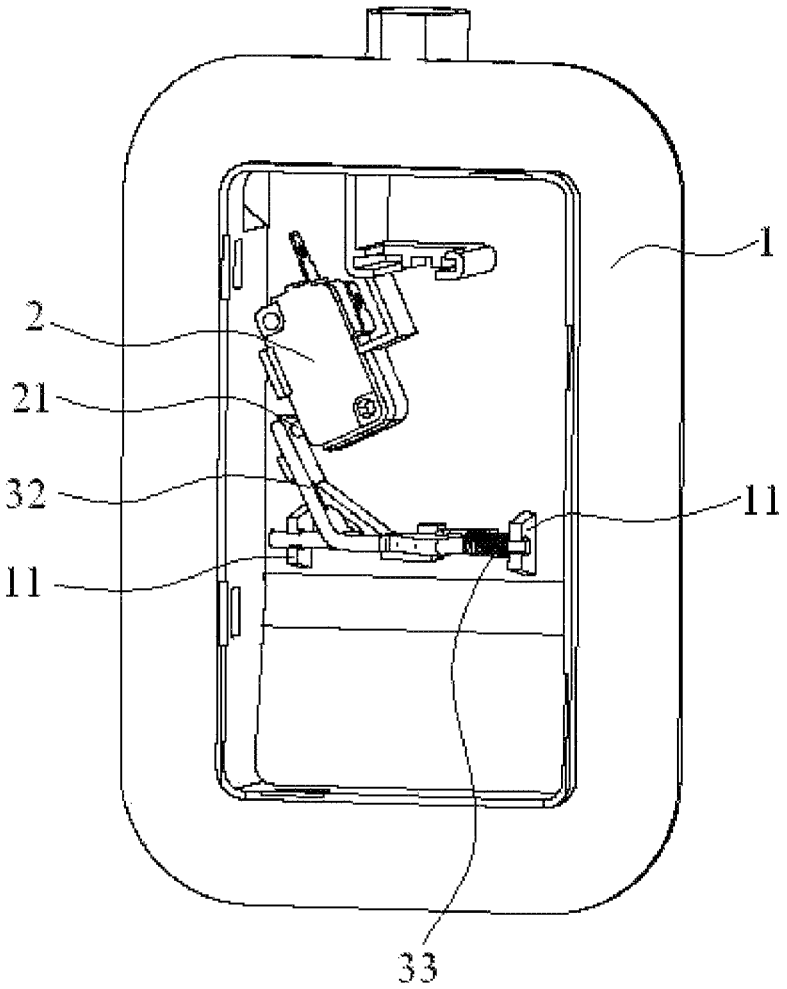
FIG. 3 is a schematic view of the internal structure of a water dispenser water-outlet assembly for refrigerators provided by the embodiments of the present disclosure.

As show in FIG. 3, the water dispenser water-outlet assembly for refrigerators illustrated by embodiments of the present disclosure comprises a housing 1 disposed in a side wall of a refrigerator body. A water-outlet switch 2 and a trigger mechanism are included in the housing 1, and the trigger mechanism 3 comprises a triggering member 32 and a driving member 31; the driving member is configured to drive the triggering member to one-dimensionally slide in a direction parallel to the side wall; the triggering member is slidably connected to the housing, and the triggering member is configured to one-dimensionally slide in a direction parallel to the side wall (also referred to as the "first direction" in the present disclosure) to trigger the water-outlet switch when it is driven by the driving member.

Since the triggering member 32 slides in a direction parallel to the side wall, compared with the rotational technical solution provided by the related art, the triggering member 32 will occupy a smaller space when moving, so that the volume of the housing 1 can be reduced, and consequently, less foam layer will be removed when embedding the housing 1 into the inner wall of the refrigerator body. As a result, the side wall of the refrigerator may retain more foam layer, and the cold insulation effect of the refrigerator may be improved.

In some embodiments, the outlet switch has a trigger point, and the triggering member is configured to trigger the water-outlet switch by touching the trigger point when one-dimensionally sliding. For example, the trigger point is located in the sliding track of the triggering member 32, so that the triggering member can touch the trigger point when one-dimensionally sliding.

of the present disclosure, when water is needed, the driving member may be enabled so that the driving member drives the triggering member 32 to slide in a first direction parallel to the side wall (e.g. move in one dimension) to trigger the water-outlet switch 2 (e.g. the triggering member triggers the water-outlet switch by touching the trigger point). Since the triggering member 32 moves in one dimension, compared with the rotational technical solution provide by the related art, the triggering member 32 will occupy a smaller space when moving, so that the volume of the housing 1 can be reduced, and consequently, less foam layer is removed when embedding the housing 1 into the inner wall of the refrigerator body. As a result, the side wall of the refrigerator may retain more foam layer, and the cold insulation effect of the refrigerator may be improved.

In some embodiments, in a normal use state, the plane of the side wall is perpendicular to the horizontal plane, and the first direction is a horizontal direction parallel to the side wall or a vertical direction parallel to the side wall, wherein the above-mentioned "perpendicular", "parallel" and "vertical" are not "perpendicular", "parallel" and "vertical" in the strict sense, and certain errors are allowed, as long as it does not affect the normal use of consumers.

The driving member is any component that can drive the triggering member to slide in a direction parallel to the side wall (also referred to as the "first direction" in the present disclosure).

In some embodiments, the driving member may be a lateral urging member, and the lateral urging member refers to a component that urges the triggering member to move in the first direction. The driving member may be a mechanical structure that can be pushed down, and it may also be an electric motor that can drive the triggering member to move (e.g., move horizontally) in the first direction, wherein the first direction may be a horizontal direction, wherein the horizontal direction means refers to a horizontal direction in a normal use state.

Figure 2:
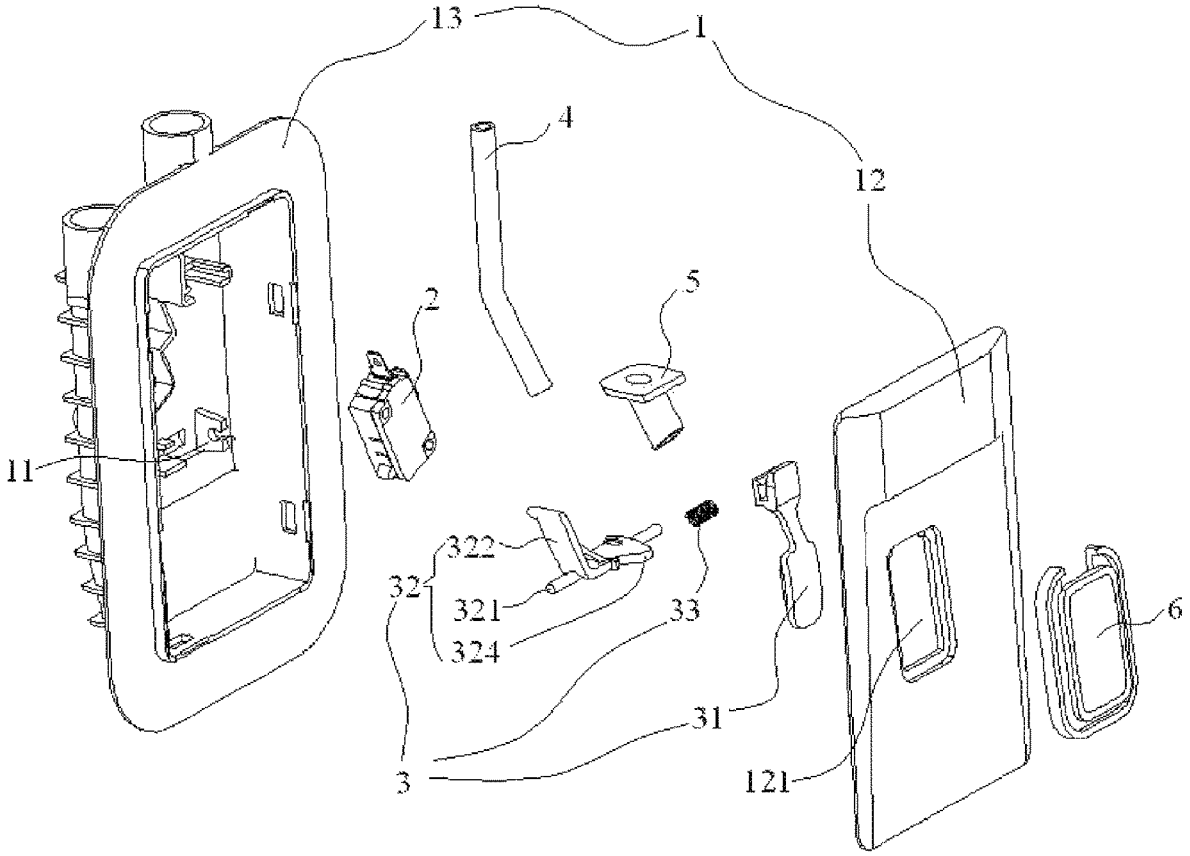
FIG. 2 is a schematic exploded view of a water dispenser water-outlet assembly for refrigerators provided by the embodiments of the present disclosure.

In some embodiments, as shown in FIG. 2, the driving member comprises a pressing member 31, a first end of the pressing member 31 is used for pressing, and a second end of the pressing member 31 interacts with the triggering member 32 on an inclined surface. The first end of the pressing member 31 refers to an end of the pressing member 31 that facing the outside of the housing 1, and the second end of the pressing member 31 is disposed opposite to the first end. The driving member and the triggering member are configured in a way that when the first end of the pressing member is pressed down in a direction perpendicular to the side wall, the second end will convert the direction of the pressing force that presses down the pressing member from a direction perpendicular to the side wall to a first direction through interaction between two inclined surfaces, so that the triggering member 32 moves in the first direction to trigger the water-outlet switch 2. In this way, the pressing force perpendicular to the side wall can be converted to a force parallel to the side wall, so that lateral space and cost can be saved.

The interaction between two inclined surfaces comprises an interaction between a second inclined surface of the driving member and a first inclined surface of the triggering member that abut against each other, and the angle between the plane of the side wall and a mutually abutting plane of the second inclined surface and the first inclined surface is less than 90°. In some embodiments, the angle is 30°-60°.

In some embodiments, the second inclined surface 311 is disposed on a second end of the pressing member 31, and the angle between the plane of the side wall and the plane where the second inclined surface 311 is located is less than 90°.

The triggering member is arranged to be slidably connected to the housing in any way, so that the triggering member may trigger a component of the water-outlet switch 2 when sliding in a direction parallel to the side wall.

In some embodiments, there exists an angle of inclination of not 0° between the direction in which the triggering member one-dimensionally slides and the mutually abutting plane of the second inclined surface and the first inclined surface, and the angle between the mutually abutting plane and the side wall is less than 90°. In some embodiments, the mutually abutting plane is parallel to a straight line which is parallel to the side wall and perpendicular to the direction in which the triggering member one-dimensionally slides. Herein, as a reference to "vertical" or "horizontal", the side wall refers to a side wall in a refrigerator parallel to the surface in which a driving member is disposed.

In some embodiments, for connection stability, as shown in FIGS. 2 and 3, the triggering member comprises a trigger lever and a trigger arm disposed on the trigger lever, and the trigger arm 322 is disposed on an end of the trigger lever 321 and faces a trigger point 21 of the water-outlet switch 2.

The trigger lever 321 and the trigger arm 322 may be of a one-piece integrated structure, or the trigger lever 321 and the trigger arm 322 may be a separable structure.

In some embodiments, the water dispenser water-outlet assembly for refrigerators further comprises a position limiting member 11 disposed in the housing. The triggering member 32 is slidably connected to the housing in the way that the triggering member 32 is slidably connected to the position limiting member. Due to the limitation of the position limiting member, the triggering member 32 driven by the driving member 31 can only one-dimensionally slide in a direction parallel to the side wall to trigger the water-outlet switch 2.

In some embodiments, the position limiting member 11 may be a supporting protrusion or a guide rail.

In some embodiments, the position limiting member 11 may be two supporting protrusions both provided with slots for accommodating the triggering lever, and two ends of the trigger lever 321 are slidably clamped on two supporting protrusions in the housing 1. Compared with the singular axle-hole fitting method provided by the related art, the technical solution provided by embodiments of the present application is more reliable as the parts are not easy to loosen.

In some embodiments, the water-outlet switch and the trigger arm are both inclined with respect to the trigger lever on a surface which they faces each other, and the angle of inclination is substantially the same. By "the angle of inclination is substantially the same", it means the difference between the two angles of inclination is within 20%.

In some embodiments, the water-outlet switch 2 and the trigger arm 322 are both inclined with respect to the trigger lever, and the angle of inclination is substantially the same, so that the trigger arm 322 may be parallel to the surface of the water-outlet switch 2, in which surface the a trigger point 21 is provided, so that the triggering member 32 can be prevented from being installed in reverse and the foolproofing effect is improved. In addition, with the water-outlet switch 2 and the trigger arm 322 disposed in an inclined manner, longitudinal space can also be saved.

In some embodiments of the present disclosure, the trigger lever is provided with a first protrusive portion 324, and the first protrusive portion 324 is provided with a first inclined surface 323. The angle between the plane of the side wall and the plane where the first inclined surface 323 is located is less than 90°. In some embodiments, the angle is 30°-60°. Moreover, the first inclined surface 323 and the second inclined surface 311 may interact with each other to convert the direction of the pressing force that presses down the pressing member to an urging force that urges the trigger lever in the first direction, so that the trigger level slides in the first direction.

In some embodiments, the position limiting member 11 may be a position limiting slot disposed along the first direction, and the triggering member comprises a sliding member disposed in the position limiting slot; the sliding member is provided with a trigger arm for triggering the water-outlet switch and a first protrusive portion 324 that interacts with a second end of the pressing member 31.

In some embodiments, the position limiting member 11 may be a guide rail along the first direction, and the triggering member may be a sliding member disposed in the guide rail.

As described above, through the interaction between two inclined surfaces, a pressing force perpendicular to the side wall may be converted to a force parallel to the side wall, so that lateral space and cost can be saved.

Figure 4:
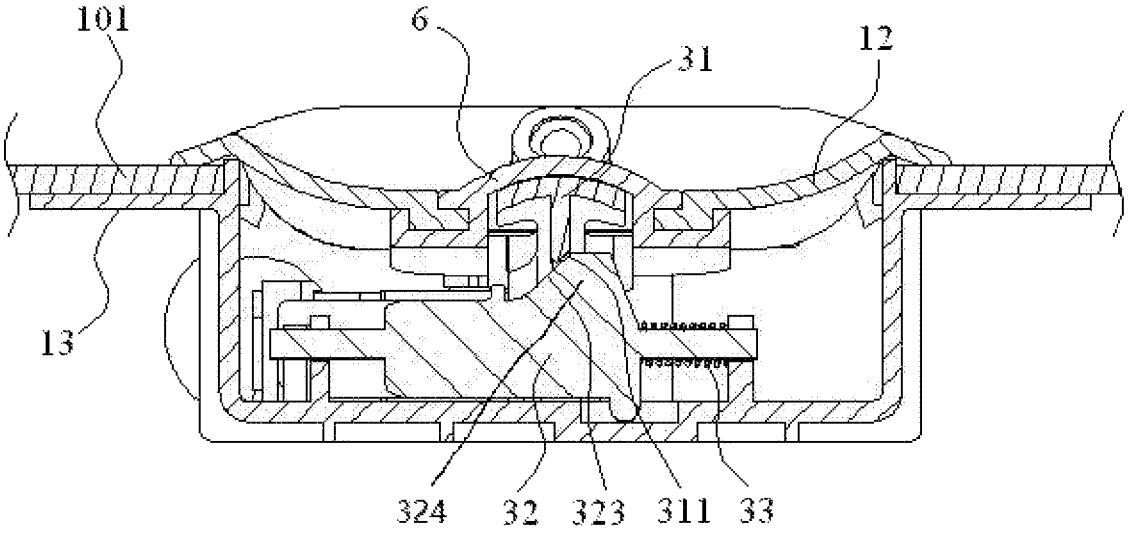
FIG. 4 is a schematic view of a horizontal section of a water dispenser water-outlet assembly for refrigerators provided by the embodiments of the present disclosure.

In some embodiments, the interaction between the inclined surfaces of the triggering member 32 and the pressing member 31 may be realized in the following manner. As shown in FIG. 4, the trigger lever 321 is formed with a first protrusive portion 324, and the first protrusive portion 324 is formed with a first inclined surface 323; a second end of the pressing member 31 in the housing 1 is formed with a second inclined surface 311, and the first inclined surface 323 and the second inclined surface 311 abut against each other. In this way, the interaction between the inclined surfaces of the triggering member 32 and the pressing member 31 can be realized.

Figure 8:
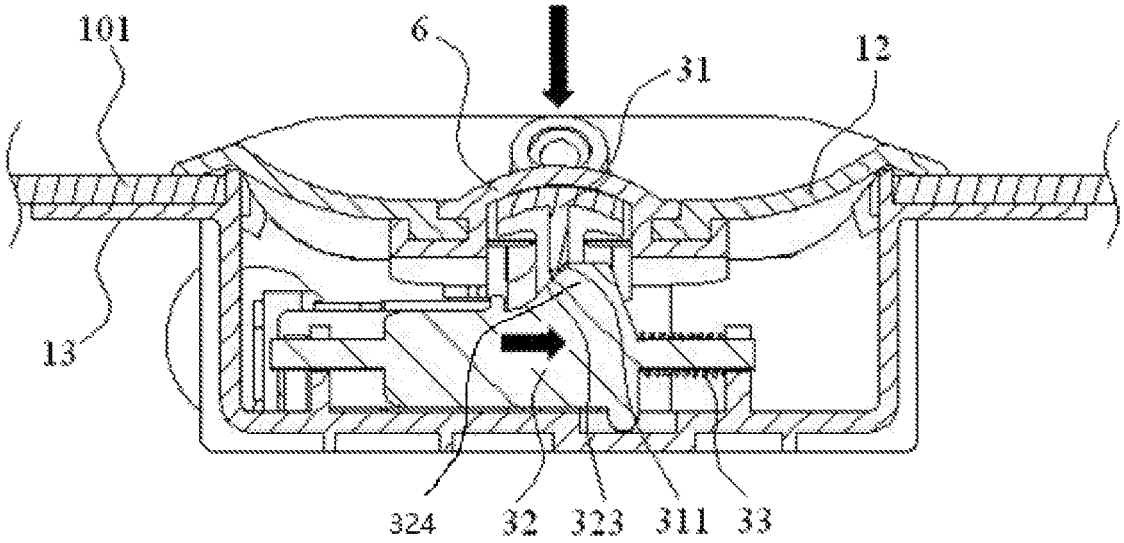
FIG. 8 is a schematic view of a horizontal section of a water dispenser water-outlet assembly for refrigerators in which interaction between two inclined surfaces occurs, which is provided by the embodiments of the present disclosure.

In some embodiments, as shown in FIG. 8, when interaction between two inclined surfaces occurs, a second end (e.g. the lower end) of the pressing member is provided with a second inclined surface 311, and the pressure acting on the pressing member is transmitted to a first inclined surface 323 of the trigger lever 321 through the interaction between the two inclined surfaces, so that the trigger lever is driven to slide to a side of the plane where the side wall is located. In this way, through the interaction between the two inclined surfaces, the direction of the pressing force that presses down the pressing member is converted from a direction perpendicular to the side wall (e.g. as shown in the downward arrow in FIG. 8) to a direction parallel to the side wall (e.g. as shown in the right arrow in FIG. 8).

In some embodiments, the resetting of the triggering member 32 may be realized by the resetting force of the button of the water-outlet switch 2, and a resetting member may also be provided separately. The resetting member is any component that applies a reset force to the triggering member that makes the triggering member move away from the water-outlet switch.

In some embodiments, as shown in FIGS. 2 and 3, the triggering member 32 is connected with a resetting member (e.g. a reset spring 33). The resetting member applies a reset force to the triggering member 32 that makes the trigger arm move away from the water-outlet switch 2. In this way, when the pressing member 31 is pressed down, the resetting member (e.g. the reset spring 33) is compressed; and when the pressing force is removed, the reset force of the reset spring 33 may drive the trigger arm of the triggering member 32 to move away from the water-outlet switch 2, so as to reset the triggering member 32. This structure can avoid the situation that the triggering member 32 cannot be completely reset because the sliding friction force between the triggering member 32 and the housing 1 is too big that the reset force of the water-outlet switch 2 cannot completely overcome the sliding friction force. The triggering member 32 will be forcibly reset by the compression elastic force of the reset spring 33, so that the problem that the switch cannot be turned off after taking water will not occur.

In the above embodiment, the reset spring 33 may be disposed as shown in FIG. 4: a first protrusive portion 324 is located between two supporting protrusions 11, and the reset spring 33 is sleeved on the trigger lever 321; one end of the reset spring 33 abuts against the first protrusive portion 324, and another end of the reset spring 33 abuts against one of the supporting protrusions 11.

Figure 5:
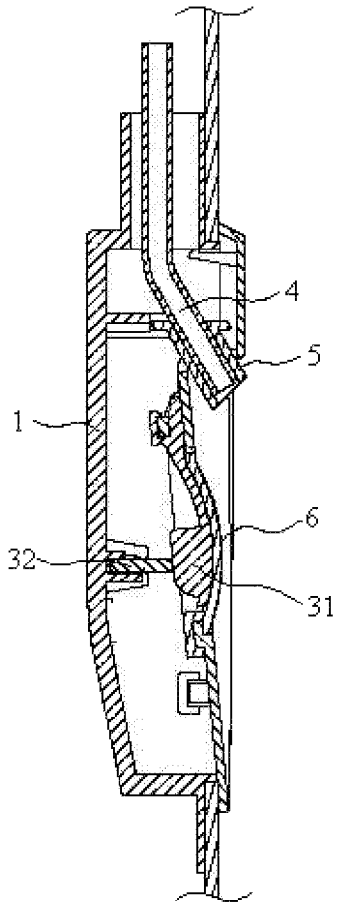
FIG. 5 is a schematic view of a vertical section of a water dispenser water-outlet assembly for refrigerators provided by the embodiments of the present disclosure.

In some embodiments, as shown in FIGS. 2 and 5, the water dispenser water-outlet assembly further comprises a water-outlet pipe 4. The lower end of the water-outlet pipe 4 is connected to a water-outlet nozzle 5. One end (e.g. the upper end) of the water-outlet nozzle is connected to the water-outlet pipe in the housing, and another end of the water-outlet nozzle sticks out of the housing 1 to allow users to get water. There are a variety of options regarding the relative positions of the water-outlet pipe 4 and the water-outlet switch 2. For example, the water-outlet switch 2 can be disposed below the water-outlet pipe 4; but under this circumstance, if the water-outlet pipe 4 is leaking (e.g. leaking at the connection between the water-outlet pipe 4 and the water-outlet nozzle 5), the water will directly drop on the water-outlet switch 2, possibly resulting in the failure of the water-outlet switch 2. In some embodiments, the water-outlet pipe 4 may be disposed on a lateral side of the water-outlet switch 2. In this way, even if the water-outlet pipe 4 leaks, the water will not drop on the water-outlet switch 2, thus improving the electrical safety performance of the assembly.

In some embodiments, the water-inlet end of the water-outlet pipe 4 may be connected with a water box disposed on the inside or outside of the refrigerator body; it may also be directly connected with a tap-water pipe outside the refrigerator. When the water-inlet end of the water-outlet pipe 4 is directly connected with a tap-water pipe outside the refrigerator, there is no need to install a water box in the refrigerator body, so that storage space is saved in the refrigerator body and water does not need to be added manually.

In some embodiments, the water-outlet pipe 4 is also connected to a water-outlet valve. The water-outlet switch 2 is used to control the opening and closing of the water-outlet valve. When the water-outlet switch 2 is triggered, the water-outlet valve opens.

As shown in FIG. 2, the housing 1 comprises a front cover 12 and a rear housing 13. The rear housing 13 is embedded in the side wall, and the front cover 12 is covered at the opening of the rear housing 13.

In some embodiments, the position limiting member 11 is fixed on the inside of the rear housing 13, and the water-outlet switch is also fixed on the inside of the rear housing 13.

Figure 6:
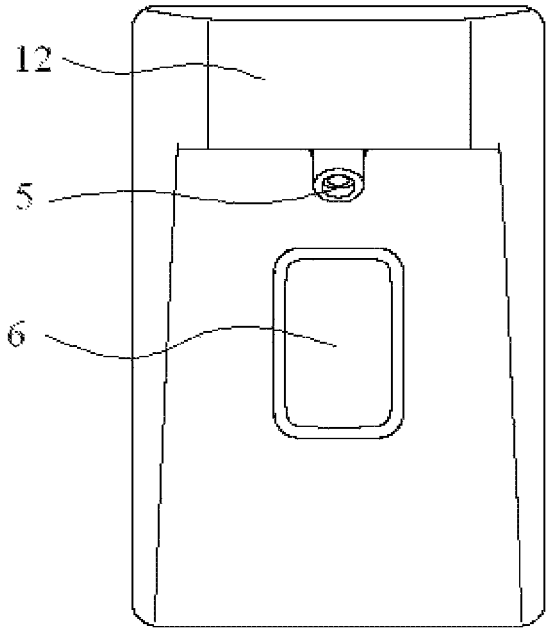
FIG. 6 is a schematic view of the exterior front structure of a water dispenser water-outlet assembly for refrigerators provided by the embodiments of the present disclosure.

In order to prevent moisture from entering the interior of the water dispenser, as shown in FIGS. 2 and 6, a pressing hole 121 is disposed in the front cover 12 of the housing 1 in a position corresponding to the pressing end of the pressing member 31. An elastic sealing plate 6 is disposed at the pressing hole 121, and the elastic sealing plate 6 seals the pressing hole 121. Therefore, the pressing of the pressing member 31 can be realized by pressing the elastic sealing plate 6, so that the internal structure inside the housing 1 can be completely sealed, and moisture inside the refrigerator can be prevented from entering the water dispenser and causing a short circuit in the electronic devices in the water dispenser. In addition, the elastic sealing plate 6 may also prevent residual water in the water-outlet nozzle 5 from falling into the interior of the water dispenser. The elastic sealing plate may be a flexible material such as rubber, which is comfortable to press and thus can improve user experience.

In some embodiments, the water-outlet switch 2 may be a mechanical switch or an electromagnetic switch. As the electromagnetic switch is easy to control and responds very rapidly, it is adopted in some embodiments. Under this circumstance, a trigger point 21 of the electromagnetic switch may be disposed facing a side wall (i.e., the second side wall) of the housing 1 perpendicular to a first direction, so that the triggering member 32 can touch the trigger point 21 of the electromagnetic switch when one-dimensionally moving in the first direction parallel to the side wall. Thus, the space in the thickness direction (i.e., the direction perpendicular to the side wall) occupied by the electromagnetic switch can be reduced to ensure adequate thickness of the foam layer.

Figure 7:
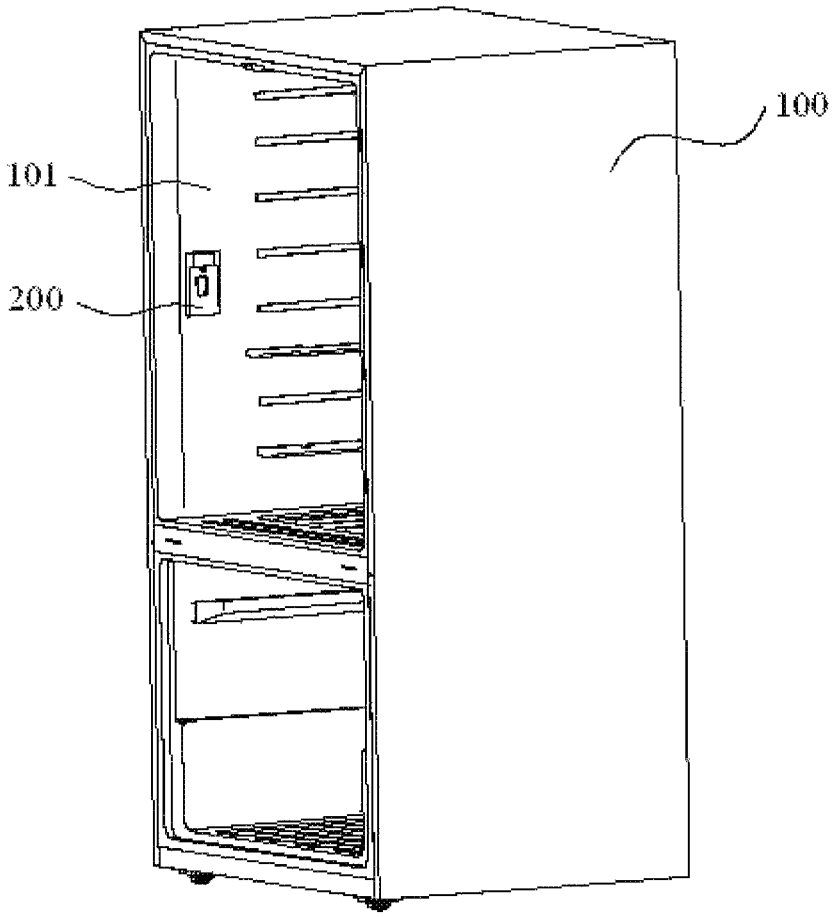
FIG. 7 is a schematic view of the structure of a refrigerator provided by an embodiment of the present disclosure.

On the other hand, as shown in FIG. 7, an embodiment of the present disclosure further provides a refrigerator comprising a refrigerator body 100. The refrigerator body 100 comprises a compartment, and at least one side wall of the compartment is provided with the water dispenser water-outlet assembly 200 described in any of the above embodiments.

In the refrigerator provided by an embodiment of the present disclosure, since the refrigerator compartment is provided with the water dispenser water-outlet assembly 200 described in any one of the above embodiments, when water is needed, the triggering member 32 may be made to slide in a first direction parallel to a side wall (i.e., the first side wall 101) to trigger the water-outlet switch 2. Since the triggering member 32 is slidable, compared with the rotational technical solution provided by the related art, the triggering member 32 will occupy a smaller space when moving, so that the volume of the housing 1 can be reduced, and consequently, less foam layer will be removed when embedding the housing 1 into the inner wall of the refrigerator body. As a result, the side wall of the refrigerator may retain more foam layer, and the cold insulation effect of the refrigerator may be improved.

The foregoing descriptions are merely some specific implementation manners of the present disclosure, but the protection scope of the present disclosure is not limited thereto, and the changes or replacements that any person skilled in the art can easily think of should be within the scope of protection of the present disclosure. Therefore, the protection scope of the present disclosure shall be subject to the protection scope of the claims.

What is claimed is:

1. A water dispenser water-outlet assembly for a refrigerator, wherein the water-outlet assembly comprises:

a housing disposed in a side wall of a refrigerator body, a water-outlet switch; and a trigger mechanism, wherein the water-outlet switch and the trigger mechanism are provided in the housing, wherein the trigger mechanism includes a triggering member and a driving member, wherein the driving member is configured to drive the triggering member to slide in a direction parallel to the side wall substantially in one-dimension, wherein the triggering member is slidably connected to the housing, and wherein the triggering member is configured to slide substantially in one-dimension in a direction parallel to the side wall to trigger the water-outlet switch when the triggering member is driven by the driving member.

2. The water dispenser water-outlet assembly according to claim 1, wherein the water-outlet switch includes a trigger point, and wherein the triggering member is configured to trigger the water-outlet switch by touching the trigger point.

3. The water dispenser water-outlet assembly according to claim 1, wherein the driving member includes a pressing member, wherein a first end of the pressing member is used for pressing, and a second end of the pressing member interacts with the triggering member on an inclined surface, and wherein the driving member and the triggering member are configured to drive the triggering member to slide in substantially one dimension in a direction parallel to the side wall through interaction between two inclined surfaces when the pressing member is pressed down in a direction perpendicular to the side wall.

4. The water dispenser water-outlet assembly according to claim 3, wherein the interaction between two inclined surfaces includes an abutment between a first inclined surface of the triggering member and a second inclined surface of the driving member, and wherein an angle between a plane defined by the side wall and at least one of the second inclined surface and the first inclined surface is less than 90°.

5. The water dispenser water-outlet assembly according to claim 4, wherein the triggering member includes a trigger lever, wherein the trigger lever is formed with a first protrusive portion, wherein the first protrusive portion is formed with the first inclined surface, and wherein an end of the pressing member in the housing is formed with the second inclined surface.

6. The water dispenser water-outlet assembly according to claim 5, wherein the triggering member includes a trigger lever and a trigger arm disposed on the trigger lever, wherein the water-outlet switch includes a trigger point, and wherein the trigger arm is disposed on an end of the trigger lever and faces the trigger point of the water-outlet switch.

7. The water dispenser water-outlet assembly according to claim 6, wherein the triggering member is connected to a resetting member, and wherein the resetting member is configured to apply a reset force to the triggering member to thereby force the trigger arm to move away from the water-outlet switch.

8. The water dispenser water-outlet assembly according to claim 7, wherein the resetting member is a reset spring.

9. The water dispenser water-outlet assembly according to claim 8, wherein the water-outlet assembly includes a position limiting member disposed in the housing, and wherein the triggering member is slidably connected to the position limiting member.

10. The water dispenser water-outlet assembly according to claim 9, wherein the position limiting member is at least one of a supporting protrusion and a guide rail.

11. The water dispenser water-outlet assembly according to claim 9, wherein the position limiting member includes two supporting protrusions in the housing, and wherein the triggering lever is slidably clamped on at least one of the two supporting protrusions in the housing.

12. The water dispenser water-outlet assembly according to claim 11, wherein the water-outlet switch and the trigger arm are both inclined with respect to the trigger lever, and wherein the angle of inclination with respect to the trigger lever is substantially the same for the water-outlet switch and the trigger arm.

13. The water dispenser water-outlet assembly according to claim 11, wherein the first protrusive portion is located between two supporting protrusions, wherein the reset spring is sleeved on a trigger lever, wherein an end of the reset spring abuts the first protrusive portion, and wherein a second end of the reset spring abuts at least one of the supporting protrusions.

14. The water dispenser water-outlet assembly according to claim 8, wherein the water-outlet switch and the trigger arm are both inclined with respect to the trigger lever, and wherein the angle of inclination with respect to the trigger lever is substantially the same for the water-outlet switch and the trigger arm.

15. The water dispenser water-outlet assembly according to claim 6, wherein the water-outlet switch is an electromagnetic switch, and wherein a trigger point of the electromagnetic switch faces a side wall of the housing in a direction that is perpendicular to the direction in which the triggering member one-dimensionally slides.

16. The water dispenser water-outlet assembly according to claim 4, wherein an inclined plane is formed between the driving member and the triggering member, and wherein the driving member and the triggering member abut along the inclined plane.

17. The water dispenser water-outlet assembly according to claim 3, wherein the water dispenser water-outlet assembly further comprises a water-outlet pipe, wherein the water-outlet pipe is located at a lateral side of the water-outlet switch, wherein the water-outlet pipe is connected with a water-outlet valve; and wherein the water-outlet valve is configured to open when the water-outlet switch is triggered.

18. The water dispenser water-outlet assembly according to claim 3, wherein a pressing hole is disposed in a front cover of the housing in a position corresponding to a pressing end of the pressing member, wherein an elastic sealing plate is disposed at the pressing hole, and wherein the elastic sealing plate seals the pressing hole.

19. A refrigerator, comprising: a refrigerator body, wherein the refrigerator body includes a compartment, and wherein at least one side wall of the compartment includes the water dispenser water-outlet assembly according to claim 1.

20. A water dispenser water-outlet assembly for a refrigerator, wherein the water-outlet assembly comprises:

a housing disposed in a side wall of a refrigerator body; and a water-outlet switch and a trigger mechanism, wherein the water-outlet switch and the trigger mechanism are provided in the housing, and wherein the trigger mechanism comprises a triggering member and a driving member, wherein the driving member is configured to drive the triggering member to slide in a direction parallel to the side wall, wherein the triggering member is slidably connected to the housing, and wherein the triggering member is configured to slide in a direction parallel to the side wall to trigger the water-outlet switch when it is driven by the driving member.

* * * * *